United States Patent [19]

Forsberg

[11] 4,215,634

[45] Aug. 5, 1980

[54] MECHANICAL MUNITION FLIGHT ENVIRONMENT SENSOR

[75] Inventor: John D. Forsberg, Wayzata, Minn.

[73] Assignee: The United States of America as represented by the Secretary of the Air Force, Washington, D.C.

[21] Appl. No.: 928,329

[22] Filed: Jul. 26, 1978

[51] Int. Cl.[2] ..... F42C 15/12

[52] U.S. Cl. ..... 102/228

[58] Field of Search ..... 102/228, 229, 226, 225, 102/244, 246, 208

[56] References Cited

U.S. PATENT DOCUMENTS

| | | | |
|---|---|---|---|
| 2,949,783 | 8/1960 | Butler | 73/514 |
| 3,670,656 | 6/1972 | Donahue et al. | 102/228 |
| 3,842,743 | 10/1974 | Zittle | 102/228 |
| 3,961,577 | 6/1976 | O'Steen | 102/208 |
| 4,015,532 | 4/1977 | Morrow | 102/244 |

*Primary Examiner*—Charles T. Jordan

*Attorney, Agent, or Firm*—Joseph E. Rusz; Henry S. Miller

[57] ABSTRACT

An environment sensing system that prevents rotation of a grooved rotor surface mounted on a shaft, with a ball, until a deceleration force causes the ball to climb an inclined surface, a bias spring causes the detent grooves to maintain alignment with the ball.

3 Claims, 5 Drawing Figures

MECHANICAL MUNITION FLIGHT ENVIRONMENT SENSOR

STATEMENT OF GOVERNMENT INTEREST

The invention described herein may be manufactured and used by or for the Government for governmental purposes without the payment of any royalty thereon.

BACKGROUND OF THE INVENTION

This invention relates generally to arming mechanisms for air dropped munitions and more specifically to an environment sensing safety system for such arming mechanisms.

Airborne munitions offer a unique challenge for those who design and construct such devices to provide a reliable arming mechanism yet one which can be maintained in a safe condition while being transported to its final destination. The high performance delivery systems utilized today, cause an arming mechanism to undergo vector forces not thought possible a decade ago.

In order to provide an appropriate arming mechanism, virtually all sciences have been approached trying to establish a system that provides the ultimate in safety and reliablity.

Mechanical systems have been suggested utilizing lanyards, springs, falling balls and cams. Electrical systems have been tried utilizing batteries, motors and printed circuits, to point out a few. However, each of the prior art arming mechanisms has shown itself to be lacking in meeting the desired goals of maximum safety and reliability combined with a reasonably low cost.

The instant invention provides a munitions arming device that meets the safety needs of munitions carried aboard high performance airborne delivery systems while continuing to maintain a high degree of reliability, while still capable of being manufactured at a low cost.

SUMMARY OF THE INVENTION

The invention is characterized by the utilization of a plurality of relatively uncomplicated reliable mechanical movements combined in a manner that overcomes the deficiencies of the known prior art arming mechanisms.

The invention is constructed to be used on a munition having at least a moderate spin characteristic as it falls freely through a fluid and experiences drag forces of useable magnitude (greater than 1/20 G).

As a munition is released from an aircraft, one of the first forces it experiences along with gravity is that of air drag. There is a natural tendency for non-restricted parts of the munitions fuze safing and arming system to move in the same direction as the munition as it experiences a drag force. This tendency occurring during deceleration is often referred to by those in the art as "creep". Creep is an acceptable environmental energy source that may be used in the design of arming mechanisms because of the reliability and predictability of devices acting under this force.

Therefore, the instant invention utilizes the "creep" force to insure maximum reliability and safety, combined with low cost, for an arming mechanism for airborne delivered munitions.

The arming mechanism, which may be adapted for nose or tail application, utilizes an airstream driven turbine as its primary source of energy. The turbine is locked in place when loaded aboard an aircraft as one safety feature of the invention. The turbine shaft is connected to a gearbox that provides as an output, one shaft having a timing cam whereby the mechanism is required to be actuated within a predetermined time. A second shaft extends from the gearbox and is used to drive the gear system in the invention.

The geared shaft turns a secondary shaft having a cam driving means positioned at one end. A mating cam follower is attached to another shaft and is turned by the cam driver. The cam follower has a key projection which turns a keyed rotor on a separate shaft. The arrangement being such that it requires three revolutions of the cam follower to turn the keyed rotor 90°.

Mounted on the shaft with the keyed rotor is an enable disc which must be turned 90° to allow an arming pin to pass through a groove in the disc. On the opposite end of the shaft is an environmental energy sensor. The sensor consists of a grooved rotor mounted on the shaft surrounded by a housing mounted and secured on an immovable portion of the arming mechanism. The housing contains three equally spaced grooves. Each groove contains a ball of sufficient size to engage the rotor and the housing to prevent movement of the rotor unless the balls are driven away from the rotor by some outside force.

The walls of the groove are so constructed as to be inclined in a direction and at an angle that will allow the balls to move away from the rotor when the munition is released and the associated drag force causes "creep" amongst the parts of the arming mechanism.

A bias spring is attached to the shaft between the environmental energy sensor and the keyed rotor for the purpose of causing the rotor to center, thereby allowing the balls to readily enter the grooves in the rotor.

It is therefore an object of the invention to provide a new and improved mechanical flight environment sensor.

It is another object of the invention to provide a new and improved mechanical flight environment sensor adopted to function with a munitions arming system.

It is a further object of the invention to provide a new and improved mechanical flight environment sensor that is highly reliable.

It is still another object of the invention to provide a new and improved mechanical flight environment sensor that requires few parts and is low in cost.

It is still a further object of the invention to provide a new and improved munition arming system that utilizes mechanical inertial and velocity sensors to provide fuze safety.

It is another object of the invention to provide a new and improved munition arming system that will function with a freely falling body having a moderate spin characteristic.

These and other advantages, features and objects of the invention will become more apparent from the following description taken in connection with the illustrative embodiment in the accompanying drawings.

DESCRIPTION OF THE PREFERRED EMBODIMENT

Figure 1:
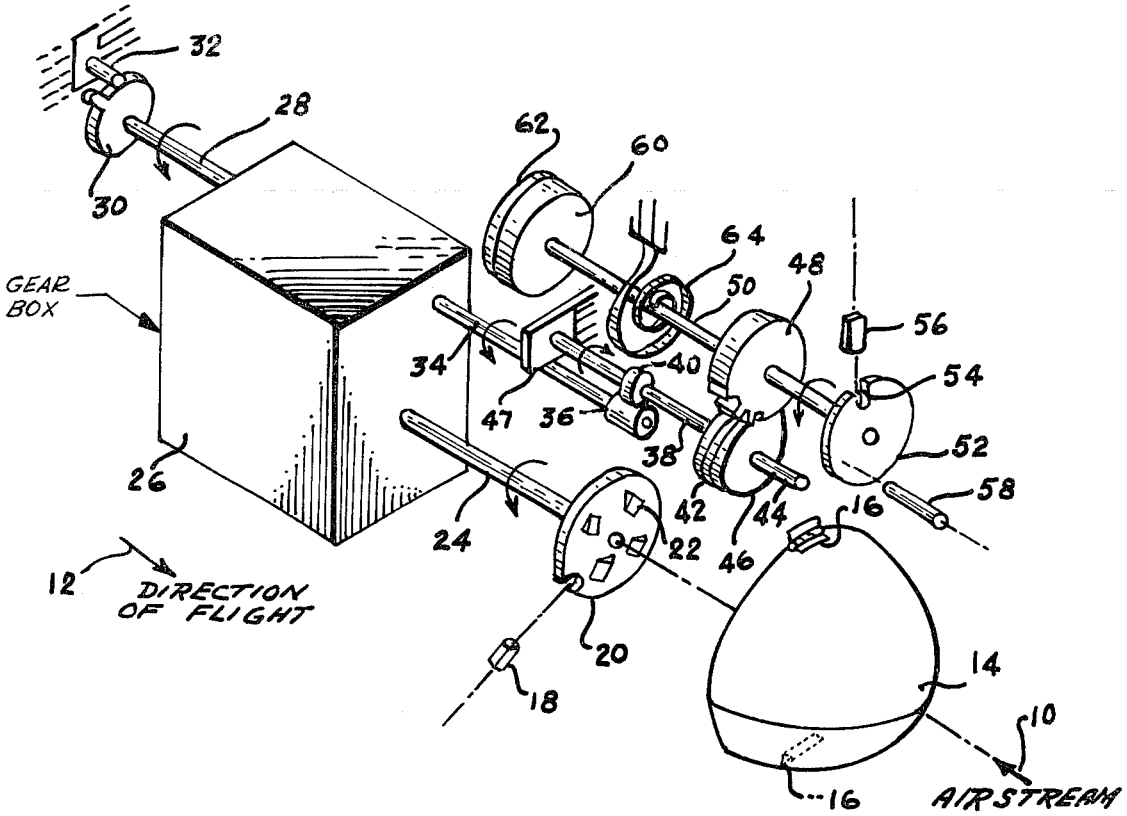
FIG. 1 is a schematic representation of the system of the invention.

Referring now to FIG. 1, there is shown a nose mounted fuse arming system according to the invention. The direction of the airstream is indicated by the arrow 10 and the direction of flight by the arrow 12. When a munition is released from an aircraft, two events occur. First, the turbine blade doors 14 swing open, via hinges 16, and secondly, the turbine gag 18 is removed allowing the turbine 20 to turn as air is captured in the buckets 22.

The turbine 20 is connected to the rotatable shaft 24 which is thence connected to the gear box 26. The gear box changes and directs the speed and rotation of the input motion as needed to operate the system.

Output from the gear box includes a first rotatable shaft 28. Mounted at one end of the shaft is a timing cam 30. As the shaft makes one revolution of appropriately 200° the timing cam comes to rest against a stop 32 causing the entire system to cease all motion. The speed of rotation of the cam 30 is controlled by a governor located in the gear box 26. The function of the timing cam in the system is to limit the time during which it is possible for the munition to arm. In the event that the remainder of the system fails to operate properly, after a predetermined time, the system is prohibited from arming itself.

A second rotatable shaft 34 extends from the gear box 26 and is shown generally parallel to the input shaft 24, although alternative configurations of the output and input shafts would work equally as well and be considered within the scope of the invention.

Mounted at one end of the shaft 34 is gear 36 having an elongated surface for purposes explained hereinafter. Another rotated shaft 38 is positioned parallel to shaft 34, and has mounted thereon a gear 40, located to engage gear 36, causing the shaft 38 to counter-rotate to the direction of the driving shaft 34. Fixed to the end of the shaft 38 is a cam driver 42. A cam follower 46 is positioned on a separate shaft 44, and is in face to face relationship with the cam driver and is driven by wedge shaped clutches as described hereinafter.

The cam follower is provided with a means for turning the keyed rotor 48 mounted on the parallel rotatable shaft 50. The keyed rotor and cam follower are so arranged that three revolutions of the cam follower are required to turn the keyed rotor 90°. After the rotor has completed a 90° rotation, the cam follower is blocked and the clutch between the cam follower (46) and cam driver 42 slips, causing the shaft 38 to move against the stepping clutch thrust spring 47. This motion in the shaft necessitates the elongated gear 36 on shift 34 to provide constant engagement between that gear and gear 40 on shaft 38.

The shaft 50 has mounted at one end an enable disc 52. The disc has a notch 54 containing a rotor gag 56 which is removed at the moment the munition is released from the aircraft. As the enable disc is rotated to a full 90°, the notch is then in line with the independent mechanical arming shaft 58 which is connected to and operates the arming mechanism for the munition.

The opposite end of shaft 50 contains the ball detent assembly 60 which prevents rotation of the shaft 50 unless a drag force is sensed on the assembly. The end plate 62 of the assembly is secured to a suitable support in the munition to prevent motion in the shaft.

Positioned between the keyed rotor 48 and the ball detent assembly 60 is a bias spring 64 which centers grooves in the ball detent assembly as will be discussed with regard to FIG. 2.

Figure 2:
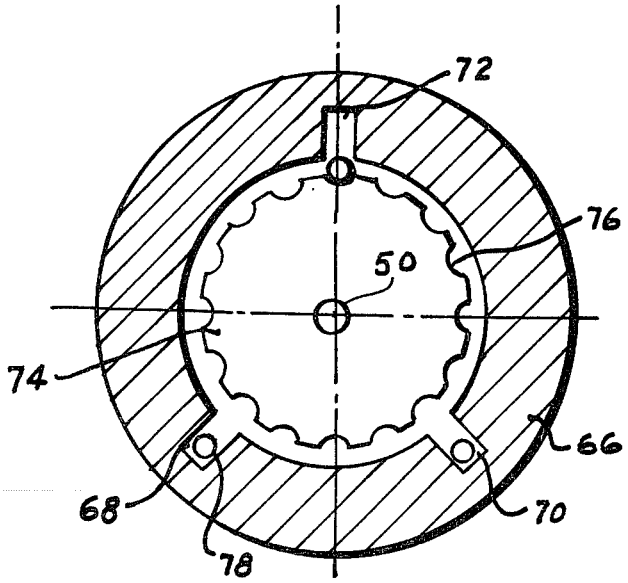
FIG. 2 is a cross-sectional view of the invention.
Figure 3:
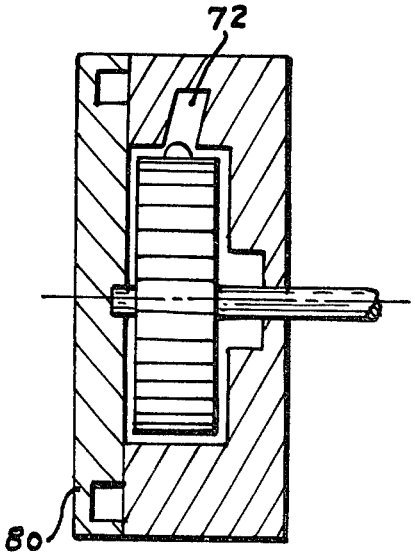
FIG. 3 is a side elevation view of the invention.

FIGS. 2 and 3 show orthogonal views of the environmental energy sensor, also referred to as the ball detent assembly 60. The assembly consists of the housing 66 having at least three spaced apart recesses 68, 70, 72. Within the housing is a rotor 74 mounted on the shaft 50. The circumference of the rotor contains longitudinal grooves or detents 76 adapted to receive balls 78. The balls 78 roll freely in the recesses 68, 70, 72; however, there is insufficient clearance between rotor 74 and housing 66 for the rotor to turn if a ball is positioned in a detent 76 as shown in FIG. 2. FIG. 3 is shown with more detail of the recess 72. The slope of the surface of recess 72 has been carefully determined in order that, as the munition travels in the direction shown by the arrow, the air drag upon being released from an aircraft will cause "creep" (referred to hereinbefore) to cause ball 78 to climb the slope surface whereby the rotor will be free to move and the system will perform the arming function described with regard to FIG. 1. FIG. 3 also shows the end cover 80 that causes the entire sensor to become enclosed and also provides support for the end of shaft 50.

Figure 4:
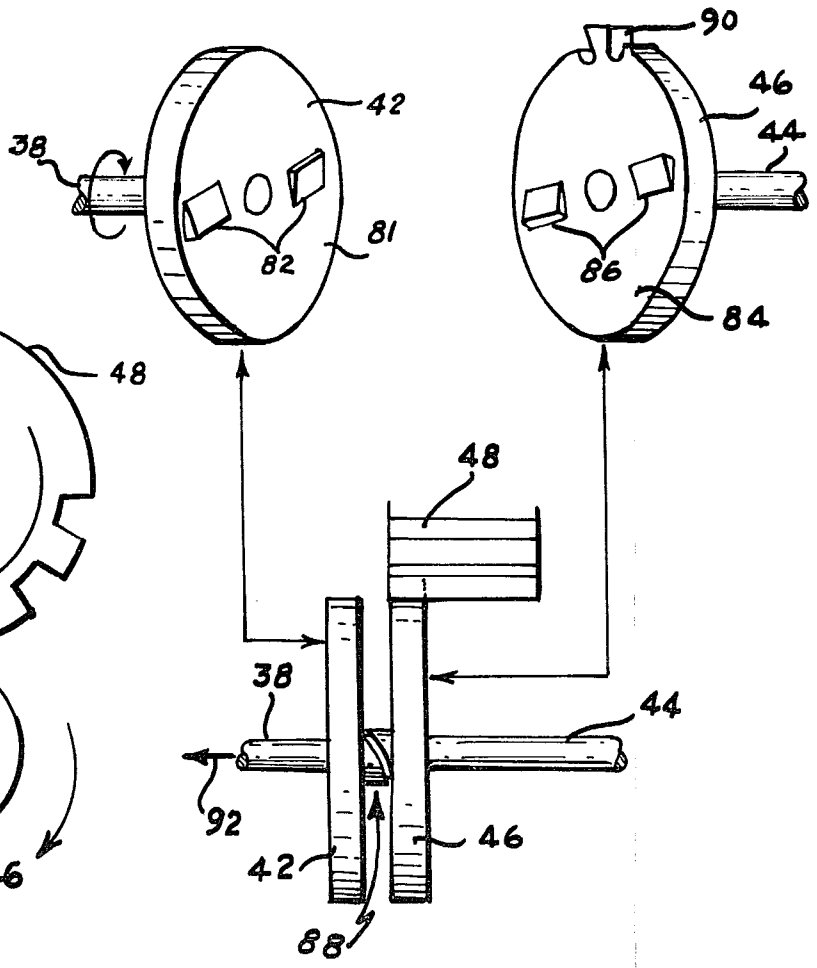
FIG. 4 is a representation of the stepping clutch utilized in the invention.

Concerning FIG. 4, there is shown, in exploded view, cam driver 42 and cam follower 46, shown in FIG. 1. Face 81 of the cam driver has mounted thereon a pair of wedge shaped members 82. The surfaces of the wedge shaped members are inclined in opposite direction as the members are positioned along a line constituting the diameter of the cam driver face and on opposite sides of the center. Cam follower 46 has a face 84 with wedge shaped members 86 positioned so as to engage the inclined surfaces of the wedge shaped members 82 as shown generally at 88. In operation, the shaft 38 turns the cam driver 42 which engages the cam follower 46. If the cam follower should become blocked because of projection 90 acting as a mechanical stop on keyed rotor 48, the cam driver will continue to turn with the wedge shaped members sliding along the inclined surfaces thereby causing the shaft 38 to move in the direction of the arrow 92 against the bias of spring 47 (FIG. 1).

Figure 5:
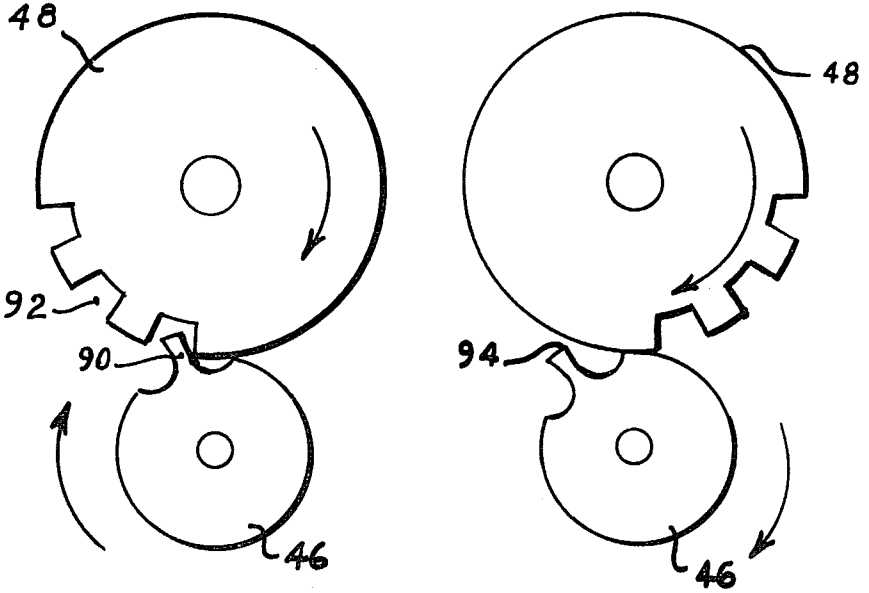
FIG. 5 is a diagramatic representation of the keyed rotor utilized in the invention.

The keyed rotor 48 is shown in detail in FIG. 5. Cam follower 46 turns the keyed rotor by means of projection 90 engaging one of the three surface slots 92. The projection and slots are so arranged that each revolution of the cam follower turns the keyed rotor 30° against the bias of spring 64. After three revolutions, the rotor has turned 90° and the cam follower is prevented from further movement as shown at 94. However, when the keyed rotor has turned 90° groove 54 in enable disc 52 is in position to receive the independent mechanical arming input 58.

Although the invention has been described with reference to a particular embodiment, it will be understood to those skilled in the art that the invention is capable of a variety of alternative embodiments within the spirit and scope of the appended claims.

It is claimed:

1. A mechanical munition flight environment sensor comprising: a shaft connected through a clutch means to an energy source; a rotor, having a plurality of grooves along the circumference thereof, mounted on one end of said shaft; a housing surrounding the rotor and having means to allow the said shaft to pass through; at least one recess in said housing having one end open facing the rotor and having one surface inclined to the longitudinal axis of the shaft; a ball housed in said recess to engage the grooved rotor of sufficient size to prevent relative movement between the rotor and the housing when seated in a rotor groove; spring means positioned along the shaft to bias a rotor groove into alignment with a recess and means for securing said housing to prevent rotational movement thereof.

2. A mechanical munition flight environment sensor according to claim 1 wherein said housing contains three equally spaced recesses.

3. A mechanical munition flight environment sensor according to claim 1 wherein two surfaces of said recess are inclined to the longitudinal axis of the shaft.

* * * * *